US008640480B2

(12) United States Patent
Lingrey et al.

(10) Patent No.: US 8,640,480 B2
(45) **Date of Patent: *Feb. 4, 2014**

(54) ROOM AIR CONDITIONER AND/OR HEAT PUMP

(75) Inventors: David J. Lingrey, San Antonio, TX (US); Kevin L. Eicher, Seguin, TX (US); Geethakrishnan Vasudevan, San Antonio, TX (US); David John Sayler, Portland, OR (US); Charles A. Wheeler, Jr., Universal City, TX (US); Patrick J. Bush, San Antonio, TX (US); Eduardo J. Guerrero, San Antonio, TX (US)

(73) Assignee: Friedrich Air Conditioning Co., Ltd., San Antonio, TX (US)

( * ) Notice: Subject to any disclaimer, the term of this patent is extended or adjusted under 35 U.S.C. 154(b) by 721 days.

This patent is subject to a terminal disclaimer.

(21) Appl. No.: 12/692,526

(22) Filed: Jan. 22, 2010

(65) Prior Publication Data

US 2011/0120167 A1 May 26, 2011

Related U.S. Application Data

(63) Continuation-in-part of application No. 29/350,863, filed on Nov. 24, 2009, now Pat. No. Des. 616,084.

(51) Int. Cl.
*F25D 23/12* (2006.01)
*F25D 19/00* (2006.01)

(52) U.S. Cl.
USPC ..... 62/298

(58) Field of Classification Search
USPC ..... 62/262, 263, 324.6, 498
See application file for complete search history.

(56) References Cited

U.S. PATENT DOCUMENTS

| | | | | | |
|---|---|---|---|---|---|
| 3,286,481 | A | * | 11/1966 | Wrench et al. | 62/202 |
| 3,293,875 | A | * | 12/1966 | Kelly | 62/180 |
| 3,911,693 | A | | 10/1975 | Seigler et al. | |
| 3,916,638 | A | | 11/1975 | Schmidt | |
| 3,938,352 | A | | 2/1976 | Schmidt | |
| 3,982,405 | A | | 9/1976 | Seigler et al. | |
| 3,990,261 | A | | 11/1976 | Smith | |
| 4,176,525 | A | | 12/1979 | Tucker et al. | |
| 4,179,894 | A | | 12/1979 | Hughes | |
| 4,384,462 | A | | 5/1983 | Overman et al. | |
| 4,516,629 | A | | 5/1985 | Bingham | |
| 4,550,770 | A | * | 11/1985 | Nussdorfer et al. | 165/242 |
| 4,570,452 | A | | 2/1986 | Bingham | |
| D284,305 | S | | 6/1986 | Lapychak et al. | |
| 4,598,558 | A | | 7/1986 | Bingham | |
| 4,633,770 | A | | 1/1987 | Taylor et al. | |

(Continued)

*Primary Examiner* — Judy Swann
*Assistant Examiner* — Christopher R Zerphey
(74) *Attorney, Agent, or Firm* — Gunn, Lee & Cave, P.C.

(57) ABSTRACT

A room air conditioner and/or heat pump is shown with a main control and a user interface. The user interface is mounted on a user interface mount attached to the front of a main unit, but behind the bezel. The user interface mount is used to (a) insert or remove the main unit, (b) secure and protect wiring cables, (c) mount the user interface thereon, (d) direct a filter into position, (e) provide a slot for a fresh air slide, and (f) direct a bezel into position. A main control housing allows access there through to a main control circuit board, but prevents moisture from dripping on the main control circuit board. A dual filter element is located behind a double hinged door. Channels and flanges direct and secure the bezel into position.

20 Claims, 15 Drawing Sheets

(56) References Cited

U.S. PATENT DOCUMENTS

| | | | | |
|---|---|---|---|---|
| 4,644,759 | A | 2/1987 | Bingham | |
| 4,818,462 | A | 4/1989 | Murano | |
| D310,410 | S | 9/1990 | Lapychak et al. | |
| D310,411 | S | 9/1990 | Lapychack et al. | |
| 5,140,830 | A | 8/1992 | Sawyer | |
| D337,816 | S | 7/1993 | Hogan | |
| 5,228,306 | A * | 7/1993 | Shyu et al. | 62/176.6 |
| D342,781 | S | 12/1993 | Thompson et al. | |
| 5,271,242 | A | 12/1993 | Addington | |
| D348,727 | S | 7/1994 | Sawyer | |
| 5,533,346 | A | 7/1996 | Freeman | |
| 5,622,058 | A | 4/1997 | Ramakrishnan et al. | |
| 5,638,692 | A * | 6/1997 | Aizawa et al. | 62/262 |
| 5,732,565 | A | 3/1998 | Ramakrishnan et al. | |
| 5,901,566 | A | 5/1999 | Mcosko et al. | |
| 6,009,717 | A * | 1/2000 | Hernandez et al. | 62/262 |
| 6,059,654 | A | 5/2000 | Kim | |
| 6,065,296 | A | 5/2000 | Feger | |
| 6,098,416 | A | 8/2000 | Addington et al. | |
| 6,102,666 | A | 8/2000 | Albrecht | |
| 6,260,371 | B1 * | 7/2001 | Moraes et al. | 62/262 |
| 6,425,256 | B1 * | 7/2002 | Bushnell et al. | 62/262 |
| 6,701,738 | B2 * | 3/2004 | Kobayashi et al. | 62/262 |
| 2007/0044496 | A1 * | 3/2007 | Ha et al. | 62/262 |
| 2008/0017723 | A1 * | 1/2008 | Johnson et al. | 236/51 |
| 2008/0085672 | A1 * | 4/2008 | Creed et al. | 454/69 |
| 2008/0134704 | A1 * | 6/2008 | Park et al. | 62/262 |
| 2011/0125328 | A1 * | 5/2011 | Lingrey et al. | 700/276 |

* cited by examiner

ROOM AIR CONDITIONER AND/OR HEAT PUMP

CROSS-REFERENCES TO RELATED APPLICATIONS

The present invention is a continuation-in-part of U.S. Design patent application Ser. No. 29/350,863, filed on Nov. 24, 2009.

BACKGROUND OF THE INVENTION

1. Field of the Invention

The present invention relates to room air conditioners that can be used for cooling and/or heating and, more particularly, to mechanical improvements located in front of the main unit.

2. Description of Related Art

Air conditioning can refer to any form of cooling, heating, ventilation, dehumidification, disinfection, or anything else that modifies the condition of air. Most people think of the terms "air conditioner" as referring to the cooling of air. Various forms of air conditioning have gone back as far as the second century in the Han Dynasty. British scientist and inventor Michael Faraday discovered that ammonia could be compressed into a liquid and allowed to evaporate to give a cooling effect. One of the earliest electric air conditioning units was invented by Willis Havilan Carrier, after whom the large heating/cooling company of Carrier Corporation is named.

Because ammonia was a toxic flammable gas, other products such as chlorofluorocarbon (CFC) were developed with a brand being marketed by DuPont Corporation becoming known as Freon. Over the years, different types of refrigerant have been developed with some refrigerants being designed particularly for heat-pump systems.

A heat-pump has the ability to bring heat into a room or to take heat out of a room. In the air conditioning cycle, the evaporator absorbs heat from inside the house and rejects the heat outside through a condenser. The condenser is located outside the space being cooled and an evaporator is located inside the space being cooled. The key component that makes a heat pump different from air conditioner is the reversing valve. The reversing valve allows for the flow direction of the refrigerant to be changed. This allows the heat to be pumped either into the space being conditioned or outside of the space being conditioned.

In the heating mode, the outdoor coil becomes the evaporator while the indoor coil becomes the condenser. The condenser dissipates the heat received from the refrigerant due to the air flowing there through and into the space to be heated. With the refrigerant flowing in the heating mode, the evaporator (outdoor coil) is absorbing the heat from the air and moving it inside. Once the refrigerant accepts heat, it is compressed and then sent to the condenser (indoor coil). The indoor coil then gives off the heat to the air moving there through which in turn heats the room being conditioned.

In the cooling mode, the outdoor coil is now the condenser and the indoor coil is the evaporator. The indoor coil will absorb heat from the air moving there through which cools the air being delivered to the room being conditioned. The condenser takes the heat from the refrigerant and transfers the heat to the outdoor air.

Heat pumps are normally used in more temperate climates. The reason for use in temperate climates is due to the problem of the outdoor coil forming ice which blocks airflow during the heating cycle. To compensate for icing during colder weather, a heat pump will have to temporarily switch back into the regular air conditioning mode to de-ice the outdoor coil. Rather than having cold air being discharged inside the space to be heated, a heating coil is switched on to heat the air being delivered through the inside coil to the space to be heated.

In the past, heat pumps were basically used in central air conditioning systems. A few of the more expensive window air conditioning units had the heat pump function. However, prior window mounted heat pumps were expensive, and had a number of drawbacks that are satisfied with the present invention.

In a window air conditioning unit or a through the wall system, normally everything is contained within the single unit. The exception might be the thermostat could be located at a remote location within the room to be heated or cooled. Otherwise the indoor coil, outdoor coil, compressor, reversing valve, motors, fans and expansion valves are all contained within a unit. That unit which is powered by electricity, must have suitable controls for operation of the unit plus give good air distribution within the space to be heated or cooled.

Prior air conditioners and/or heat pumps may not have convenient/readily accessible user interface with all of the latest electronic controls easily mounted for operation by the user. Also, the prior units were difficult to insert inside of the outer housing.

In prior air conditioner/heat pumps, connecting wires or wiring cables had a tendency to run haphazardly behind a bezel or control enclosure cover and not be solidly located into position. Further moisture had a tendency to collect on the control circuitry and short out the control circuitry. Even electrical connections to the unit were sometimes a problem because wall receptacles could end up on the opposite side of the unit from the power cord connection.

Accessibility to filters or the effectiveness of the filters is always a problem in a room air conditioner and/or heat pump. There must be structural integrity to the door opening up to the filter element. The filter must be secured into place to ensure air flow there through. Most traditional air conditioners/heat pumps do not have anything to eliminate odor such as a carbon filter.

Because the bezel is separate from the main air conditioner and/or heat pump, there is a problem of alignment there between. When the air conditioner and/or heat pump and the bezel are secured together, there must be structural integrity between the two.

BRIEF SUMMARY OF THE INVENTION

It is an object of the present invention to provide a user interface mount that satisfies multiple needs.

It is another object of the present invention to provide structural support for a user interface, while at the same time rigidly maintaining cables and cable connections in place on an air conditioner and/or heat pump.

It is yet another object of the present invention to provide a mount for the main control of an air conditioner and/or heat pump while at the same time allowing access thereto and preventing condensation from collecting thereon.

It is still another object of the present invention to provide an air conditioner and/or heat pump that has an easy to use, easy to replace filter that gives the maximum amount of filtration to the room being conditioned.

It is still another object of the present invention to provide an odor eliminating filter system for a room air conditioner and/or heat pump.

It is still another object of the present invention to provide structural integrity to the hinges and snaps of a front-hinged door which allows access to the filter of the room air conditioner and/or heat pump.

It is still another object of the present invention to provide alignment features to align and secure the bezel in position when connected to the main body of the air conditioner and/or heat pump.

An air conditioner and/or heat pump is shown that has a main control mounted behind the bezel, but on the front of the main body of the air conditioner and/or heat pump there is access to a user interface. The main control is contained in a main control housing to prevent moisture condensation from reaching the main control circuit board while allowing access to the main control.

The main control connects to a user interface mounted on a user interface mount on the front of the main body of the air conditioner and/or heat pump. Through an opening in a bezel access is provided to the user interface with touch control functions being accessible through the opening. The user interface mount satisfies many functions including (a) structural strength to insert or remove the main body of the air/conditioner and/or heat pump, (b) maintaining wires and wiring cables in place inside the air conditioner and/or heat pump, and (c) holding a filter in position in the air stream.

Posts on the backside of the bezel helps align the bezel and secure the bezel in position on the body of the air conditioner and/or heat pump. Channels also ensure that the bezel is properly aligned and secured.

Double hinges give extra strength to the lower hinged front door which allows access to a removable filter located there behind. The removable filter has two separate filters hinged together with the first filter being a separate mesh filter, but a second filter being a carbon filter to help eliminate odor.

These and other features of the present invention are illustrated in the following drawings and description of the preferred embodiment.

BRIEF DESCRIPTION OF THE DRAWINGS

FIG. 4 is an exploded perspective view with the bezel exploded from the air conditioner and/or heat pump and with the user interface, user interface mount, main control, main control housing and main control housing mount being separately shown there between.

DESCRIPTION OF THE PREFERRED EMBODIMENT

Figure 1:
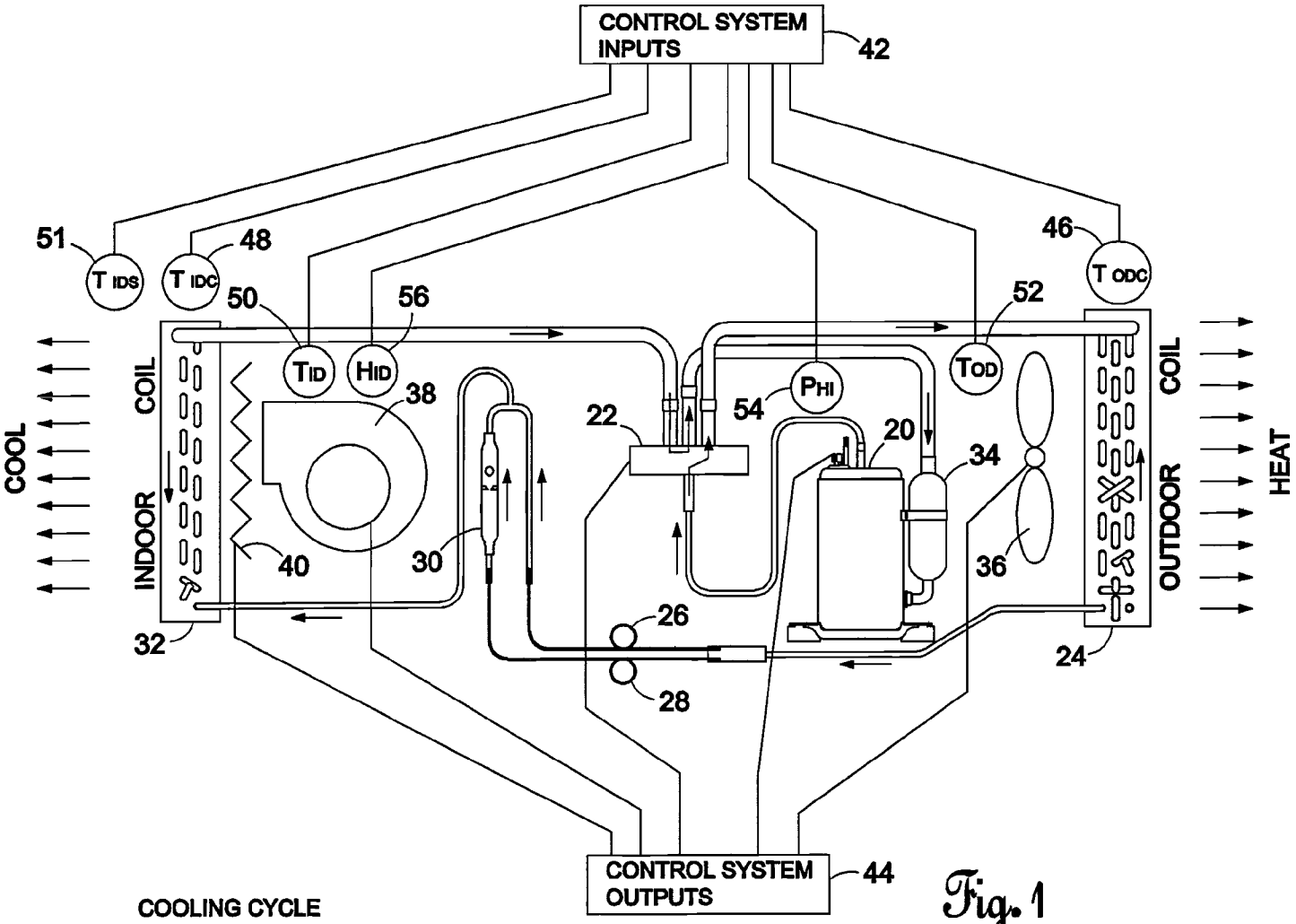
FIG. 1 is a schematic pictorial diagram of an air conditioner/heat pump made according to the present invention which is operating in the cooling cycle.

A combination room air conditioner/heat pump is pictorially illustrated in FIG. 1. A refrigerant is compressed inside of compressor 20 and flows there from in the direction indicated by the arrows through reversing valve 22. The refrigerant changes from the vapor state to the liquid state in outdoor coil 24. The outdoor coil 24 is acting as a condenser and is giving off heat to the air flowing there through.

From the outdoor coil 24 the refrigerant flows through heating/cooling capillary tube 26 and cooling capillary tube 28. From the cooling capillary tube the refrigerant flows through check valve 30. Both streams of the refrigerant are combined together and allowed to expand inside of indoor coil 32. The indoor coil 32 is functioning as an evaporator and is therefore absorbing heat from the air flowing there through to give a cooling effect. Inside of the indoor coil 32 the refrigerant is changing from a liquid to a vapor state.

From the indoor coil 32 the refrigerant flows through the reversing valve 22 in the directions indicated by the arrows to the accumulator 34.

Simultaneously, a fan 36 forces air through the outdoor coil 24 and a blower 38 directs air through the indoor coil 32. While not used in the cooling cycle, a heater coil 40 is located in the path of airflow through the indoor coil 32.

The controls for the air conditioner illustrated in FIG. 1 are for simplicity purposes divided between control system inputs 42 and control system outputs 44. A temperature sensor 46 is located on the outdoor coil 24 and is referred to as $T_{ODC}$. Likewise a temperature sensor 48 is mounted on the indoor coil 32 and is used to measure the temperature thereof and is referred to as $T_{IDC}$. The temperature sensor 51 is measuring the air as it comes out of the indoor coil 32 and is referred to as the temperature of the indoor supply $T_{IDS}$.

Located in the airstream of air coming into the air conditioner from the room being cooled is a temperature sensor 50, which measures the indoor temperature and is referred to as $T_{ID}$. Temperature sensor 50 ($T_{ID}$) is what is used to set the desired indoor temperature. Temperature sensor 52 is located in the airstream of the outdoor air being brought into the air conditioner and measures outdoor air temperature and is referred to as $T_{OD}$.

On the discharge side of the compressor 20 is a pressure sensor 54 which measures the high pressure $P_{HI}$ of the refrigerant being discharged from the compressor 20. The pressure sensor 54 may be used to shut the system down if extreme pressure is generated or something is not functioning properly.

An indoor humidity sensor 56 is also located in the path of the air being brought into the air conditioner to measure relative humidity and is also referred to as $H_{ID}$.

While not shown in the pictorial diagram of FIG. 1, the voltage level of the incoming line voltage is also measured so that if the voltage gets too high or too low, operation of the air conditioner will stop until line voltage gets back into normal levels. For example, in brown-out conditions the air conditioner would shut OFF.

Using the information collected from temperature sensors 46, 48, 50, 51 and 52, pressure sensor 54 and indoor humidity sensor 56, control system outputs 44 are generated. Control systems outputs 44 may control the speed of fan 36 and/or blower 38. The control of the speed may be ON, OFF, various set points, or may have an infinitely variable speed by using pulse width modulation. While the fan 36 and blower 38 may be driven by single motor, they may also be driven by separate motors which allows for independent variation of their respective speeds.

Also the control system output 44 controls the operation of the compressor 20 and the reversing valve 22. If extra heat is necessary during a heating cycle, heater coil 40 may be turned as will be subsequently described.

Figure 2:
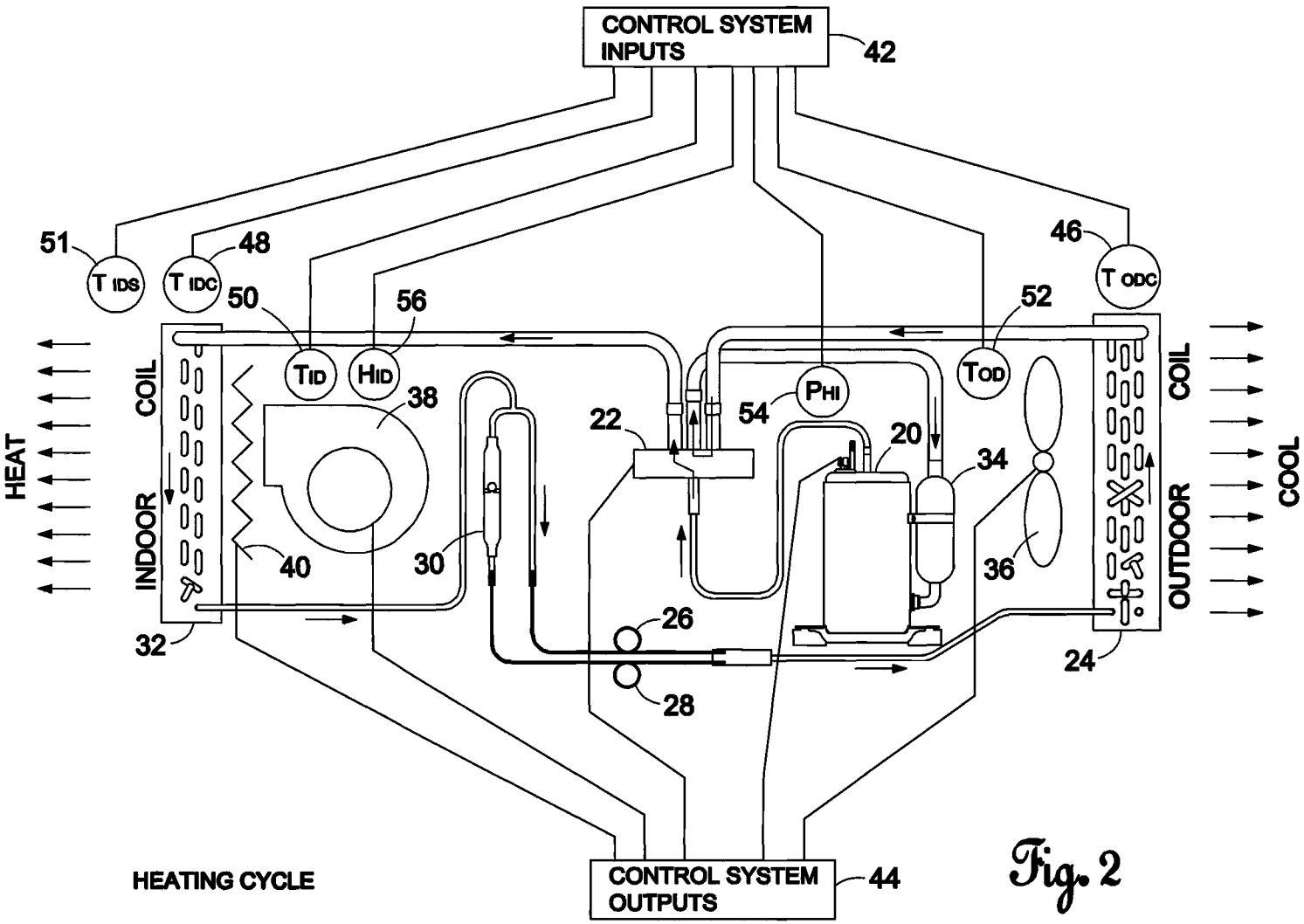
FIG. 2 is the same pictorial schematic diagram as shown in FIG. 1 except the air conditioner/heat pump is operating in the heating cycle.

As soon as the air conditioner as shown in FIG. 1 is switched from a cooling mode to a heating mode, it now functions as a heat pump, which is illustrated in FIG. 2. The control system outputs 44 are used to switch the reversing valve 22 to change the direction of flow of the refrigerant there through. When operating in the heating mode, the compressed gas changes to a liquid in the indoor coil 32, which is now acting as a condenser. As a result the indoor coil 32 now gives off heat to the air flowing there across. The flow of the liquid refrigerant from the indoor coil 32 cannot flow through the check valve 30 which closes. Therefore, the refrigerant only flows through the cooling/heating capillary tube 26. The restricted flow allows the refrigerant which is in a liquid state to expand inside of outdoor coil 24, which is now operating as an evaporator.

The outdoor coil 24 absorbs heat from the air flowing there across, therefore discharging cool air to the outside. The vapor in the outdoor coil 24 flows through the reversing valve 22 into the accumulator 34 of the compressor 20. The refrigerant is then compressed again and the cycle repeated.

During the heating cycle in cold weather, sometimes the outdoor coil 24 will freeze up. During those occasions it may be necessary to reverse cycle the unit to remove ice from the outdoor coil 24. When that occurs, the heater 40 is turned ON so that warm air will continue to flow into the room being heated. The speed of the fan 36 and the blower 38 may also be varied as is desired by the particular operation.

Figure 3:
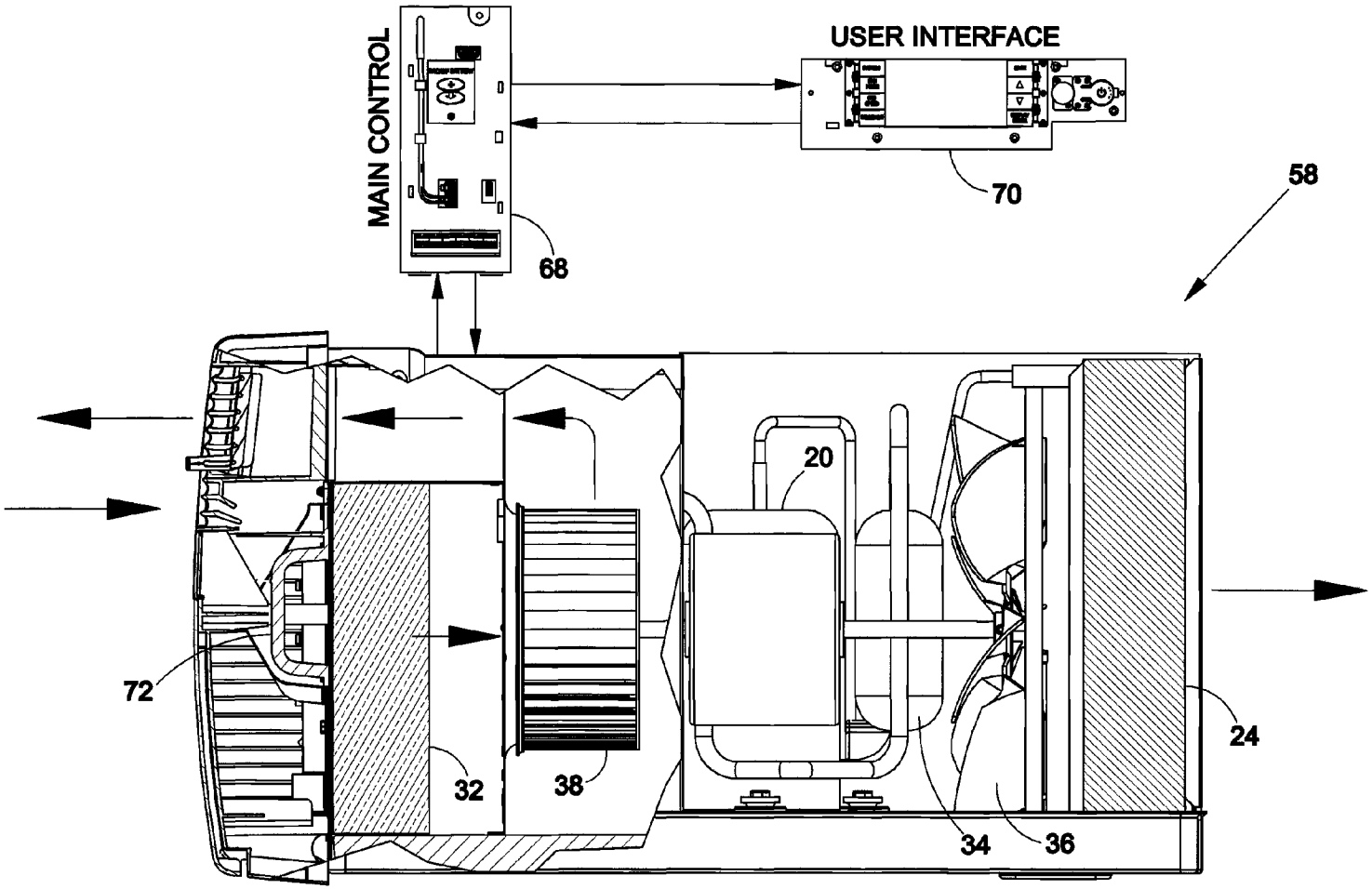
FIG. 3 is a side view of an air conditioner/heat pump with a partial cut-away to show internal components therein and an exploded view of the main control and user interface.

Referring now to FIG. 3, a typical air conditioner/heat pump 58 is shown with portions being broken away or exploded for illustration purposes. The air conditioning/heat pump unit 60 is illustrated by the portion within the bracket, which air conditioning/heat pump unit 60 has a bezel 62 on the front thereof. In the break away view of FIG. 3, internal components of the air conditioner/heat pump 58 can be seen, including the indoor coil 32 and outdoor coil 24 along with the fan 36 and blower 38. In the background the compressor 20 and accumulator 34 can also be seen. The arrows in the air conditioner/heat pump 58 illustrate the direction of movement of air there through.

Exploded from the air conditioner/heat pump 58 for display purposes is the main control 68 and the user interface 70. As will be explained in more detail subsequently, the main control 68 is located in the left hand side toward the front and the user interface 70 is located on the user interface mount 72.

Figure 4:
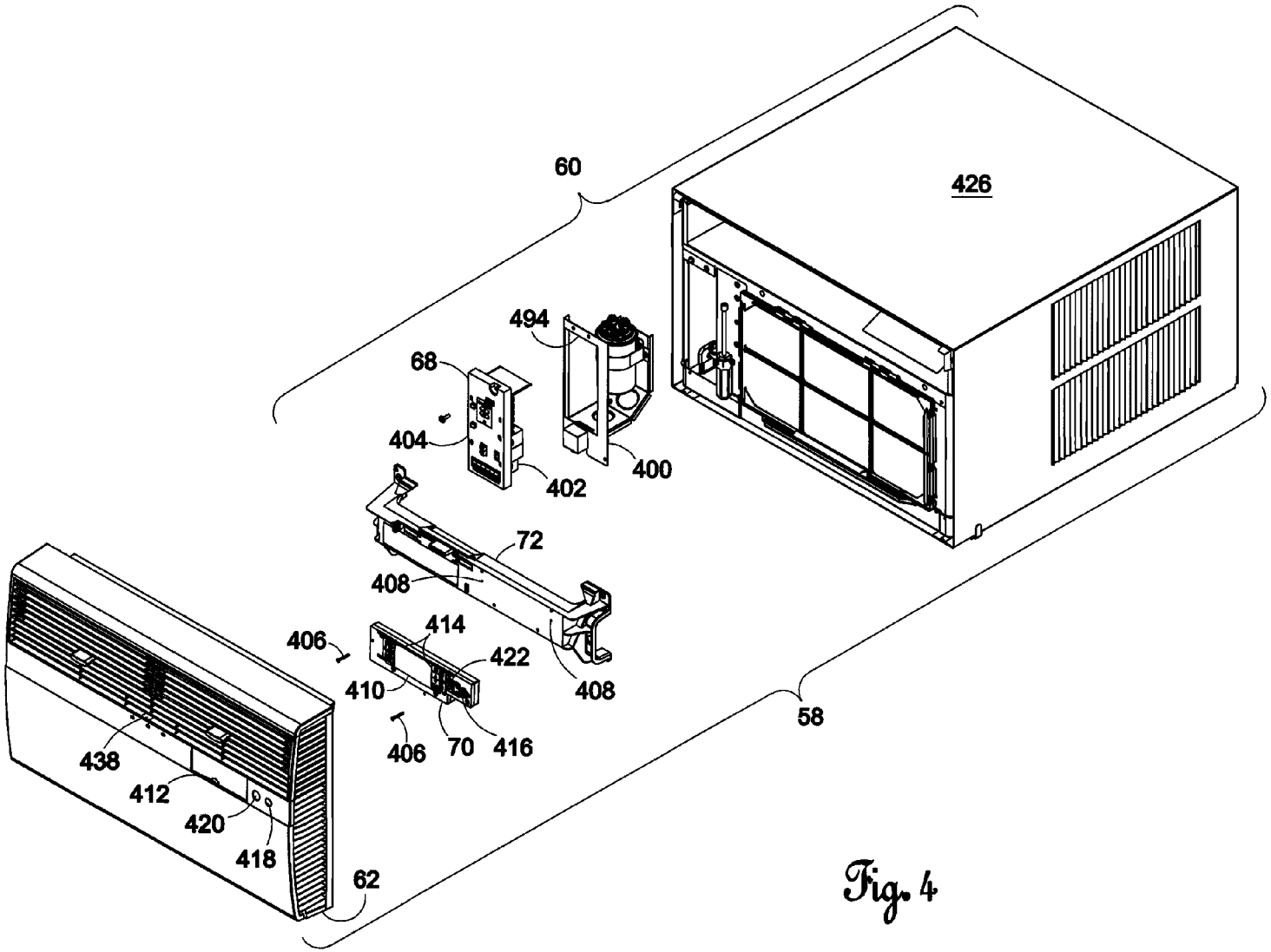

Referring now to FIG. 4, the air conditioner/heat pump 58 is shown with the bezel 62 exploded away from the unit 60. Located between the unit 60 and the bezel 62, also in an exploded perspective format, is the user interface mount 72, user interface 70, main control 68 and a main control housing mount 400. The main control 68 has a main control circuit board 402 and a relay board (not separately shown) mounted on the backside of main control housing 404.

The user interface 70 is rigidly attached to the front of the user interface mount 72 by screws 406. To help align the user interface 70 on the user interface mount 72, tits 408 extend outward there from to be received in holes (not shown) in the back of the user interface 70. On the front of the user interface 70 is a liquid crystal display 410 that is designed to fit exactly inside of opening 412 in bezel 62. On either side of the liquid crystal display 410 are user controls 414. The user controls 414 are also accessible on either end of opening 412 of bezel 62. The user controls 414 may be used to change or set the functions of the air conditioner/heat pump 58. A power button 416 is located towards the right of user interface 70, which power button 416 is accessible through hole 418 in bezel 62.

In the event the user of the air conditioner/heat pump 58 has a remote control, a signal from a remote control (not shown) can be received through remote signal port 420 in bezel 62 by IR receiver 422 on the right front side of the user interface 70. The IR receiver 422 is located in the remote signal port 420 to receive signals from a remote control device (not shown).

Figure 5A:
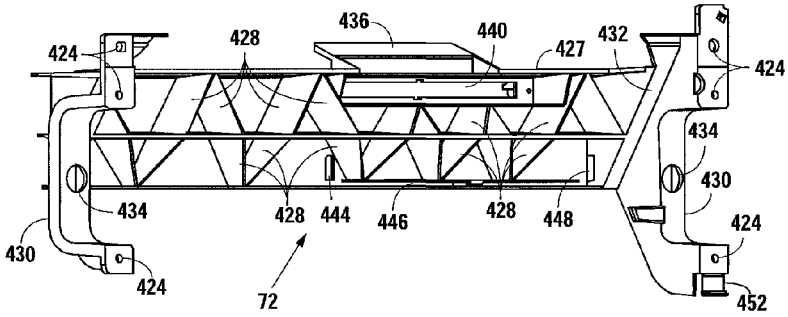
FIG. 5*a* is a rear perspective view of the user interface mount.
Figure 5B:
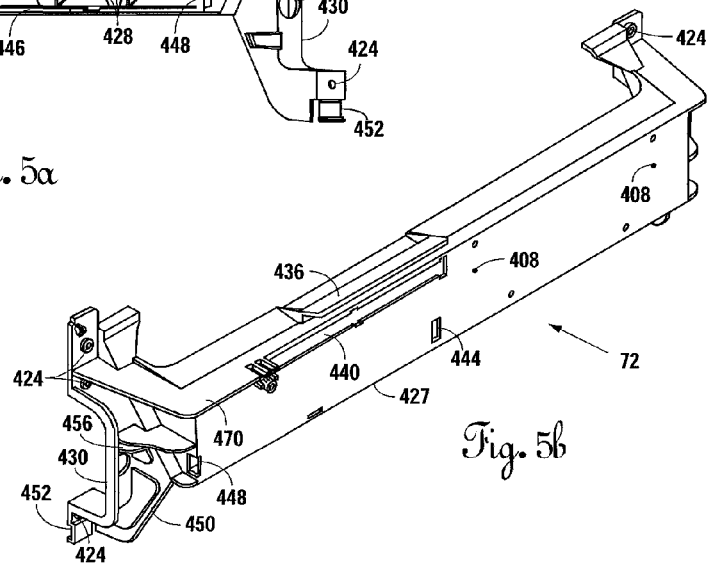
FIG. 5*b* is a front perspective view of the user interface mount.

Referring now to FIGS. 5*a* and 5*b* in combination, front and rear perspective views of the user interface mount 72 are shown, but enlarged for the purposes of illustration. The user interface mount 72 has a main body 427 with handles 430 on either end thereof. The handles 430 have screw holes 424 in each corner thereof for receiving screws there through (not shown) for attachment to the face of the unit 60 contained inside of outer housing 426. (See FIG. 4.) By the use of cross-bracing ribs 428 on the backside of the main body 427 of the user interface mount 72, the user interface mount 72 is very light weight, but structurally very strong. A person can grip the handles 430 on either end of user interface mount 72 and use those handles to insert (or remove) the fairly heavy unit 60 inside of the outer housing 426 after the outer housing 426 is properly mounted.

On the backside of the user interface mount 72 is located a slide 432 on either end thereof for directing the filter 504 (as will subsequently be explained) into place. Also, post openings 434 are used to receive posts 148 there through (as will be subsequently described) when mounting the bezel 62 on the unit 60.

Lip 436 is located in approximately the center of the air conditioner/heat pump 58 and protects the fresh air slide 438

(see FIG. 4). The fresh air slide 438 slideably movable back and forth in fresh air slide slot 440. By moving the fresh air slide to the left when facing the air conditioner/heat pump 58, fresh air is brought inside of the room being conditioned. By moving the fresh air slide 438 to the right, air is being exhausted from the room being conditioned. By having the fresh air slide 438 in the middle, air is being recirculated. Recirculation of air in the room is the most efficient mode for heating or cooling.

To prevent damage and disconnection, the user interface mount helps maintain all wires or wire harnesses in a very rigid and secure position. By viewing FIGS. 4, 5*a* and 5*b* in combination with FIG. 6, the features of the user interface mount 72 that maintain wires or wiring cables in rigid positions is illustrated. The wiring cable 442 from the user interface 70 goes into a first wiring cable slot 444, through wiring cable guide 446 on the backside of the main body 427 of user interface mount 72, and out second wiring cable slot 448. The end of the wiring cable 442 that connects to the main control 68 extends from the second wiring cable slot 448 through a second wiring cable guide 450 is held in place by wire retainer 453 and under cable clamp 452, before connecting to the main control 68.

Extending from the main control 68 is a $T_{IDS}$ wire 454 that connects in the front thereof to temperature sensor $T_{IDS}$ 51. $T_{IDS}$ wire 454 is held in place by wire retainer 453. The $T_{IDS}$ wire 454 extends under cable clamp 452, through second wiring cable guide 450, through wiring cable redirection 456 and through cable clamp 458 and is anchored in the supply air plenum to give the temperature of the indoor supply air $T_{IDS}$. (See FIGS. 1 and 2.) Indoor temperature $T_{ID}$ is provided by $T_{ID}$ wire 460 being physically connected to the frame of the main control 68 by clips 461 and 463 to hold the temperature sensor $T_{ID}$ 50 in the air passage.

The fresh air slide 438 moves the fresh air slide bracket 464 contained fresh air slide slot 440, which fresh air slide bracket 464 is connected to fresh air slide cable 466 via push nut 465. The fresh air slide cable 466 is held in position by fresh air cable retaining screw 468, extends under fresh air slide flange 470, through cable clamp 458 to fresh air flap (not shown).

For diagnostic testing or for programming the memory of the main control circuit board 402, a USB port 472 is provided through the main control housing 404 to the main control circuit board 402. Also, if a wall thermostat is to be utilized, hard wire connectors 474 are accessible through the front of main control housing 404 for hard wire connection to the wall thermostat (not shown). As can be seen from the above description, the user interface mount 72 provides many other functions other than mounting the user interface 70 thereon.

Figure 6:
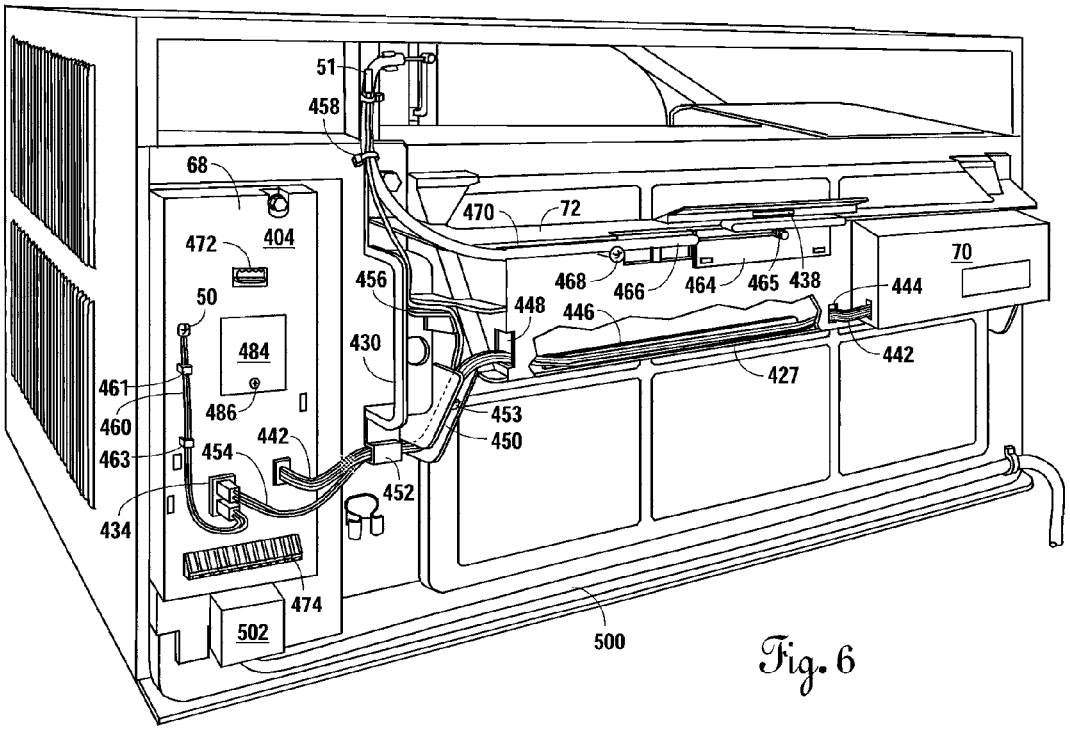
FIG. 6 is a pictorial front perspective view of the air conditioner and/or heat pump with the bezel removed, illustrating locations of wires and wiring cables.
Figure 7A:
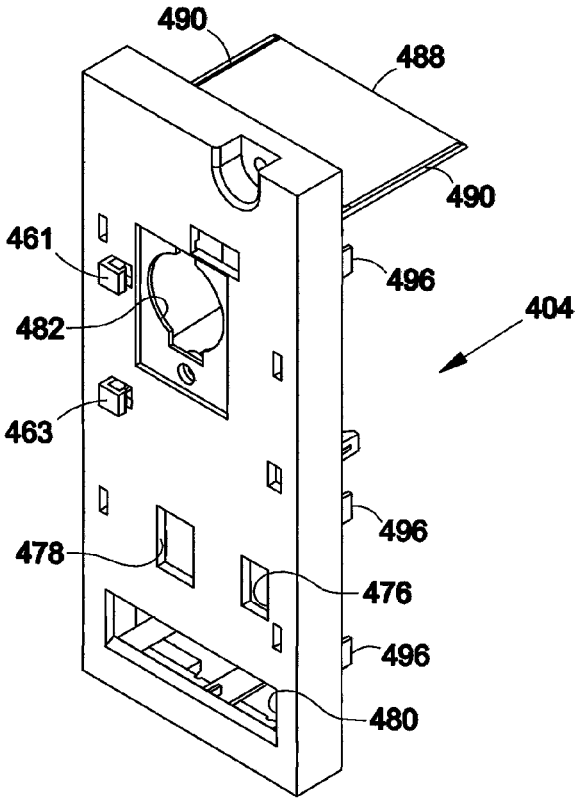
FIG. 7*a* is a front perspective view of the main control housing.
Figure 7B:
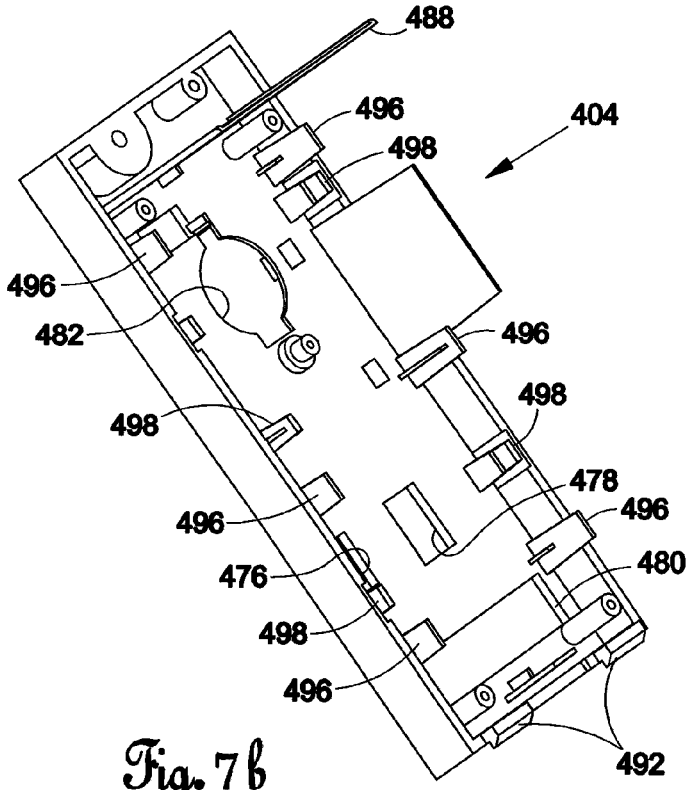
FIG. 7*b* is a rear perspective view of the main control housing.

Referring now to FIG. 7*a* and FIG. 7*b* in combination, the main control housing 404 will be explained in further detail. The main control circuit board 402, as can be seen in FIG. 4, is mounted on the backside of the main control housing 404. As can be seen by the combination of FIGS. 6, 7*a* and 7*b*, wiring cable 442 connects to the main control circuit board 402 through opening 476. Likewise, $T_{IDS}$ wires 454 and $T_{ID}$ wires 460 connect through opening 478 to the main control circuit board 402. Hard wire connectors 474 for a wall thermostat (not shown) on the main control circuit board 402 extend through slot opening 480 and the main control housing 404. A backup emergency battery (not shown) mounted on main control circuit board 402 is accessible through battery opening 482 in the main control housing 404. The battery opening 482 may be closed by battery cover 484 held in place by screw 486 as can be seen FIG. 6.

When the air conditioner/heat pump 58 is in the cooling cycle, sometimes there is a possibility for moisture to accumulate and run down onto the controls. This is prevented by moisture control flange 488 that extends rearward over the main control circuit board 402. When installed, the moisture control flange 488 has a slight downward taper towards the rear thereof to direct any moisture to drip off of moisture control flange 488 in such a way that the moisture will not hit the main control circuit board 402. Side flanges 490 keeps the moisture on top of moisture control flange 488 until the moisture drops harmlessly off of the end thereof.

Bottom clips 492 fit over the lowermost edge of opening 494 contained in main control housing mount 400 (see FIG. 4). Guides 496 also direct the main control 68 into position inside of opening 494 of the main control housing mount 400. Clips 498 help hold the main control circuit board 402, or the components thereof, in position.

Figure 8A:
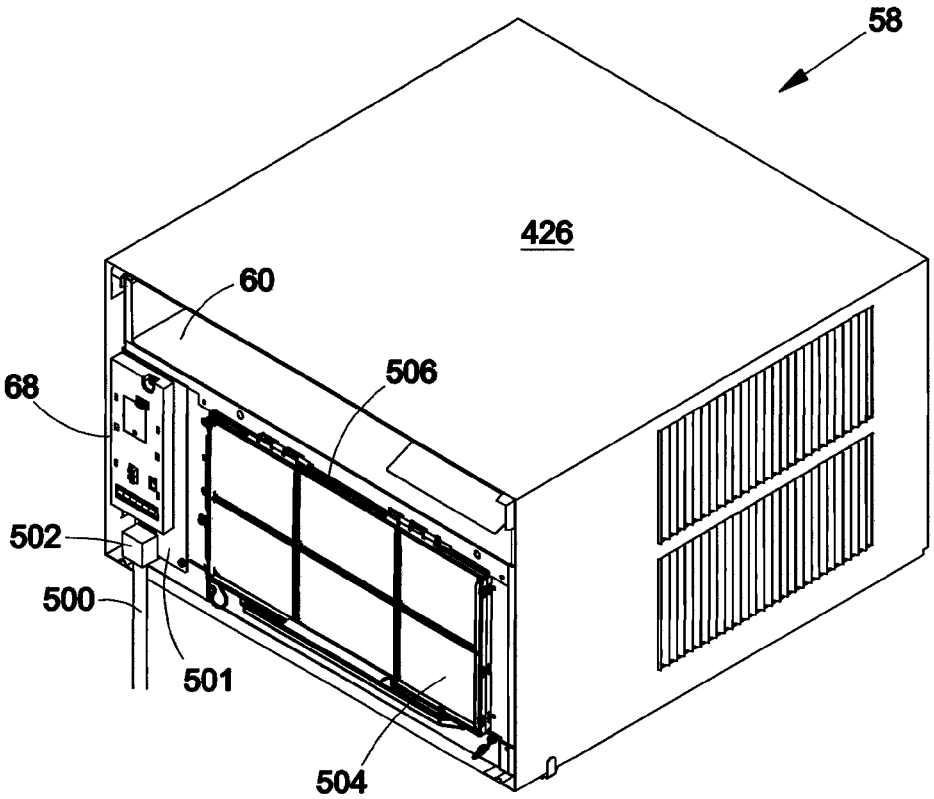
FIG. 8*a* is a pictorial front perspective view of the air conditioner and/or heat pump with the bezel removed and the electrical connection being on the left side.
Figure 8B:
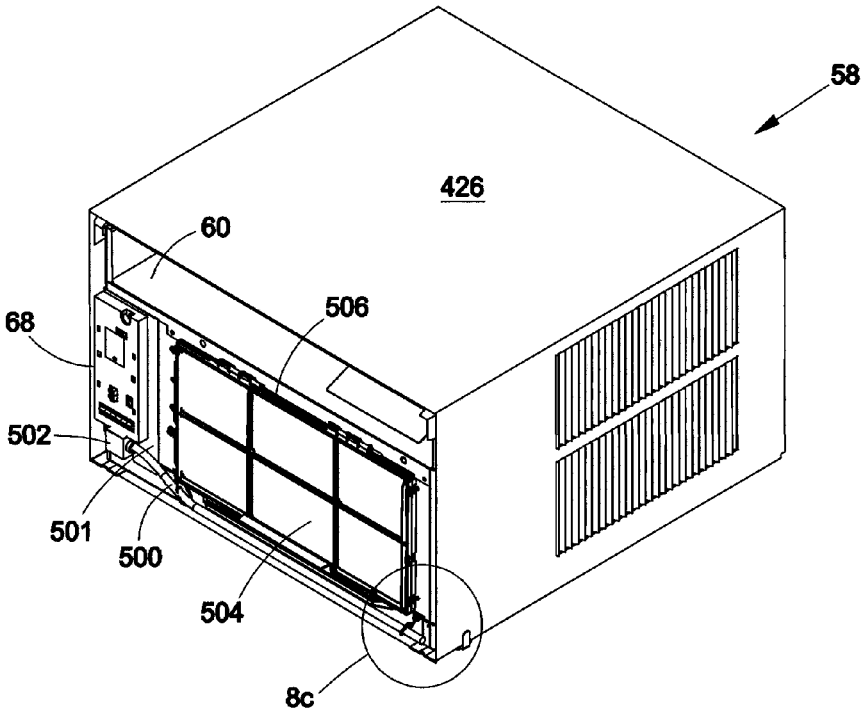
FIG. 8*b* is a pictorial front perspective view of the air conditioner and/or heat pump with the bezel removed and the electrical connection being on the right side.
Figure 8C:
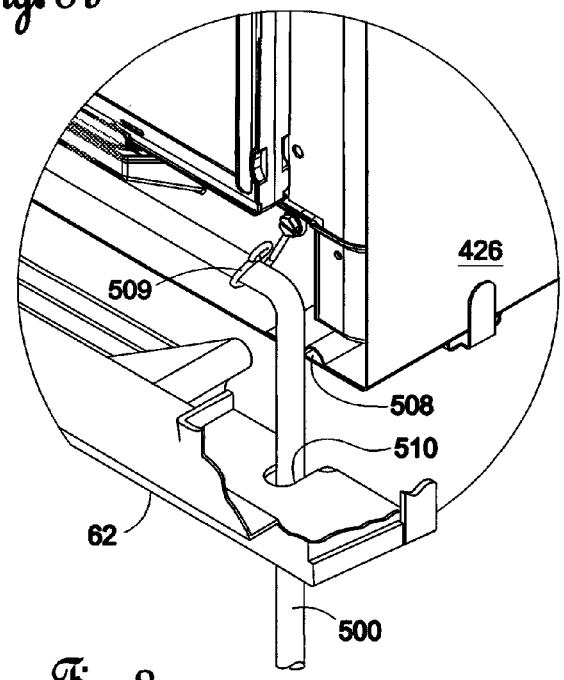
FIG. 8*c* is an enlarged exploded perspective view of FIG. 8*b* along section line 8*c*.

Referring to FIGS. 8*a*, 8*b* and 8*c* in sequence, different options for connection of a power cord 500 is shown. Assuming the power plug in which the air conditioner/heat pump 58 is to be connected is located below or to the left of where the unit is mounted, the power cord 500 will come out of the outer housing 426 from the main control 68 in a vertical downward direction. The power cord 500 has on the end thereof a square connector 502 which allows it to be rotated 90° when connected to the main control 68. The square connector 502 has slots there around (not shown). When the square connector 502 is installed in an opening at the bottom of fuse plate 501, the slots (not shown) receive the face plate 501 therein. The square connector 502 with the slots receiving the face plate 501 acts as a cord pullout for strain relief to prevent damage. In the configuration as shown in FIG. 8*a*, the power cord 500 extends vertically downward.

Referring to FIG. 8*b*, assume the wall receptacle in which the air conditioner/heat pump 58 is to be plugged in, is located to the right of where the unit 60 is mounted. In this case, the square connector 502 that connects into the main control 68 is rotated 90° so that the power cord 500 runs horizontally just inside of the outer housing 426. As can be seen in the enlarged view of FIG. 8*c*, the power cord 500 turns 90° to go out through a slot 510 contained in the outer housing 426. Clip 509 helps hold the power cord 500 in position. Bezel 62 has a similar slot 510 to accommodate the power cord 500 extending downwardly there from. In the manner as described in FIGS. 8*b* and 8*c*, the power cord 500 is held securely inside of the outer housing 426 until it exits through slot 510. Rib 508 is added to outer housing 426 for stiffening purposes.

Figures 9A, 9B:
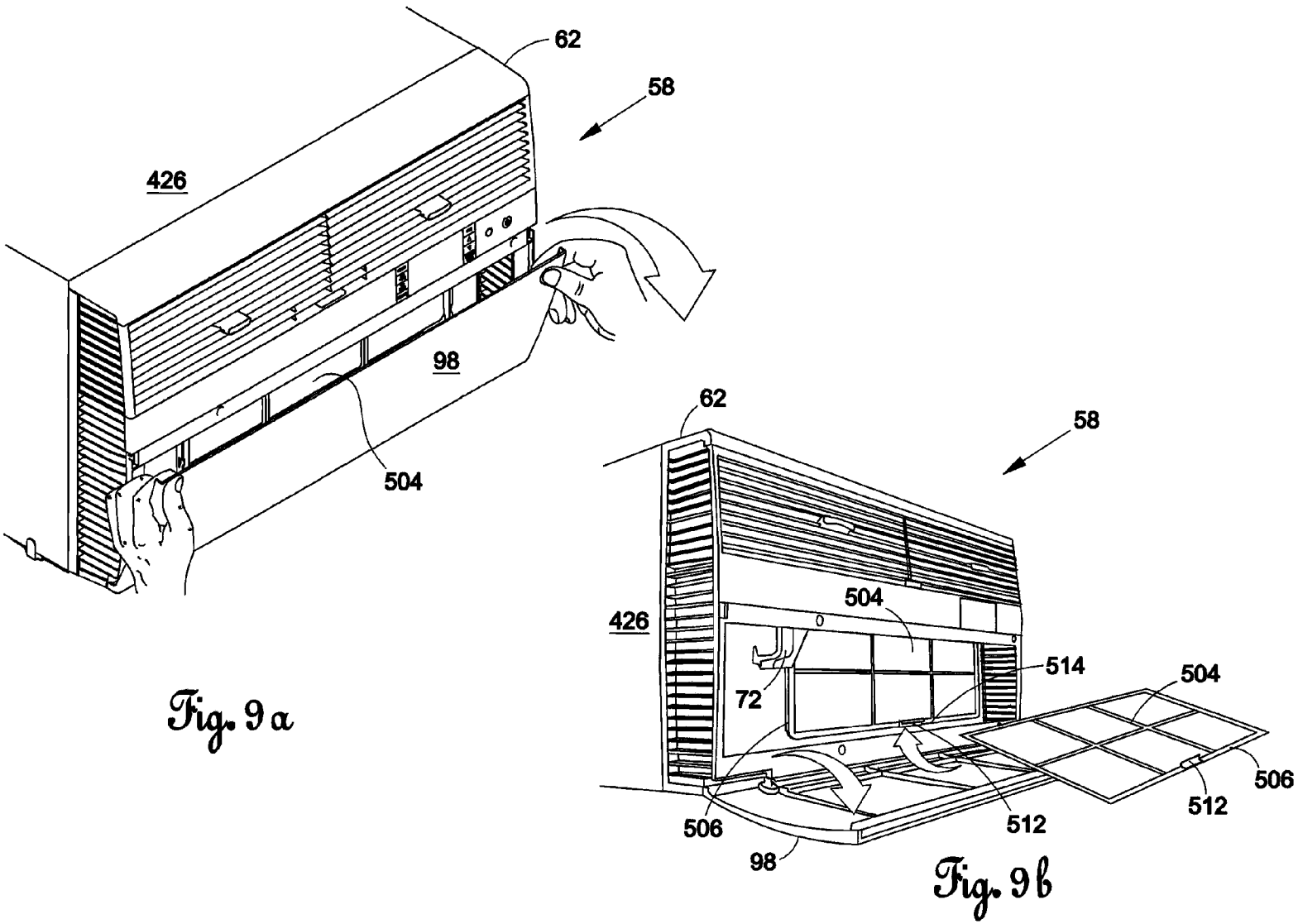
FIG. 9*a* is a partial perspective front view of the air conditioner and/or heat pump illustrating the opening of a lower hinged front door.
FIG. 9*b* is a sequential view from FIG. 9*a* illustrating how to replace the filter in the air conditioner and/or heat pump.

In FIG. 8*a*, with the bezel 62 being removed from the unit 60, the position of the filter 504 and filter frame 506 is illustrated. Referring now to FIGS. 9*a* and 9*b* in sequence, the lower hinged door 98 of the air conditioner/heat pump 58 is being opened as is illustrated by the arrows. Behind the lower hinged door 98 is the filter 504. Once the lower hinged door 98 is fully opened as is illustrated in FIG. 9*b*, the filter 504 may be removed by pushing upward on the filter handle 512 in the direction indicated by the arrow. This will release the filter frame 506 from the filter grip 514. The filter grip 514 is shaped to receive the filter 504 and filter handle 512 therein, yet continually urge the filter 504 inward for a snug fit during normal operation. Thereafter, the filter 504 can be removed by pulling the filter handle 512 forward as is pictorially illustrated by the arrows.

As can be seen in FIG. 9*b*, the top of the filter 504 is not visible under the user interface mount 72. The slide 432 of the user interface mount 72 (see FIG. 5*a*) forces the top of the filter 504 securely in position while the bottom of the filter 504 is held in position by the filter handle 512 having lower taper (not shown) that presses against a similar, but opposing, taper in filter grip 514.

Figure 10A:
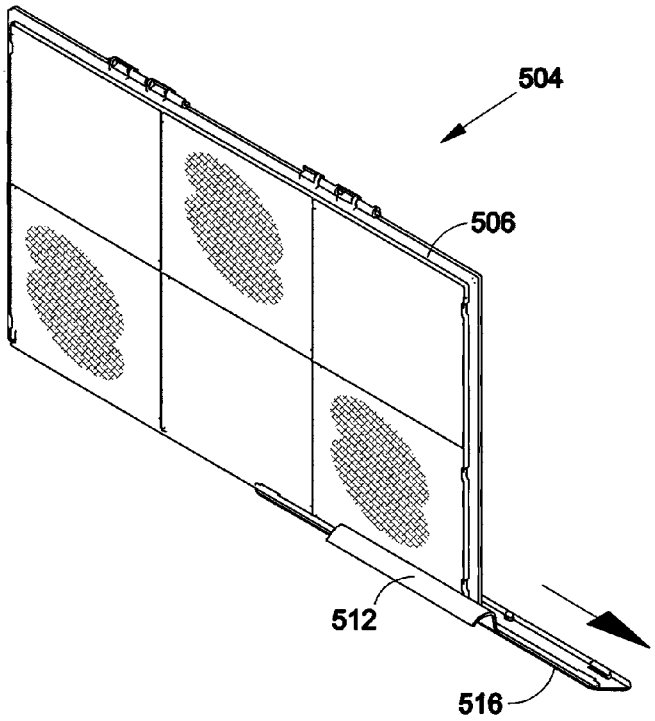
FIG. 10*a* is a perspective view of the filter illustrating the removal of the filter grip.
Figure 10B:
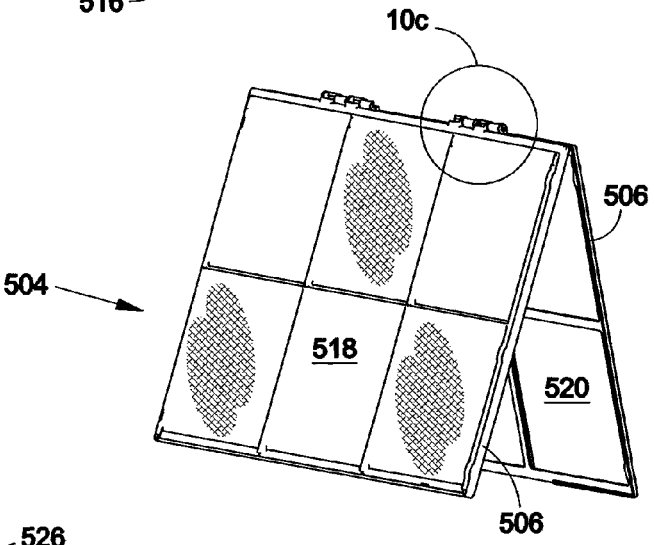
FIG. 10*b* is a perspective view of the filter with each half being pivotally separated.

Referring now to FIG. 10*a*, the filter 504 has now been removed from the air conditioner/heat pump 58. By removing clip 516 from the filter frame 506, the two halves of the filter 504 can be opened as is illustrated in FIG. 10*b*. In the front of the filter frame 506 is a standard mesh filter 518. However, in the back of the filter 504 is a carbon filter 520. The carbon filter 520 removes odor from the conditioned space, plus the carbon filter 520 catches finer particles that were not caught in the standard mesh filter 518 thereby improving the capture of particles by the filter 504. As is illustrated in FIG. 10*d*, the carbon filter 520 can be replaced and the mesh filter 518 can be cleaned and be reused. Corners of both the standard mesh filter 518 and the carbon filter 520 are tacked under flanges 522 in the corners of filter frame 506. The carbon filter 520 is normally replaced, but the mesh filter 518 may be reused after cleaning Only after repeated cleaning and reuse would the mesh filter 518 need to be replaced.

Figure 10C:
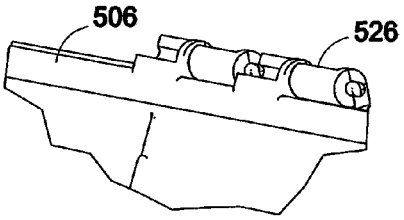
FIG. 10*c* is an enlarged perspective view of FIG. 10*b*, along section line 10*c* illustrating the hinged connection.
Figure 10D:
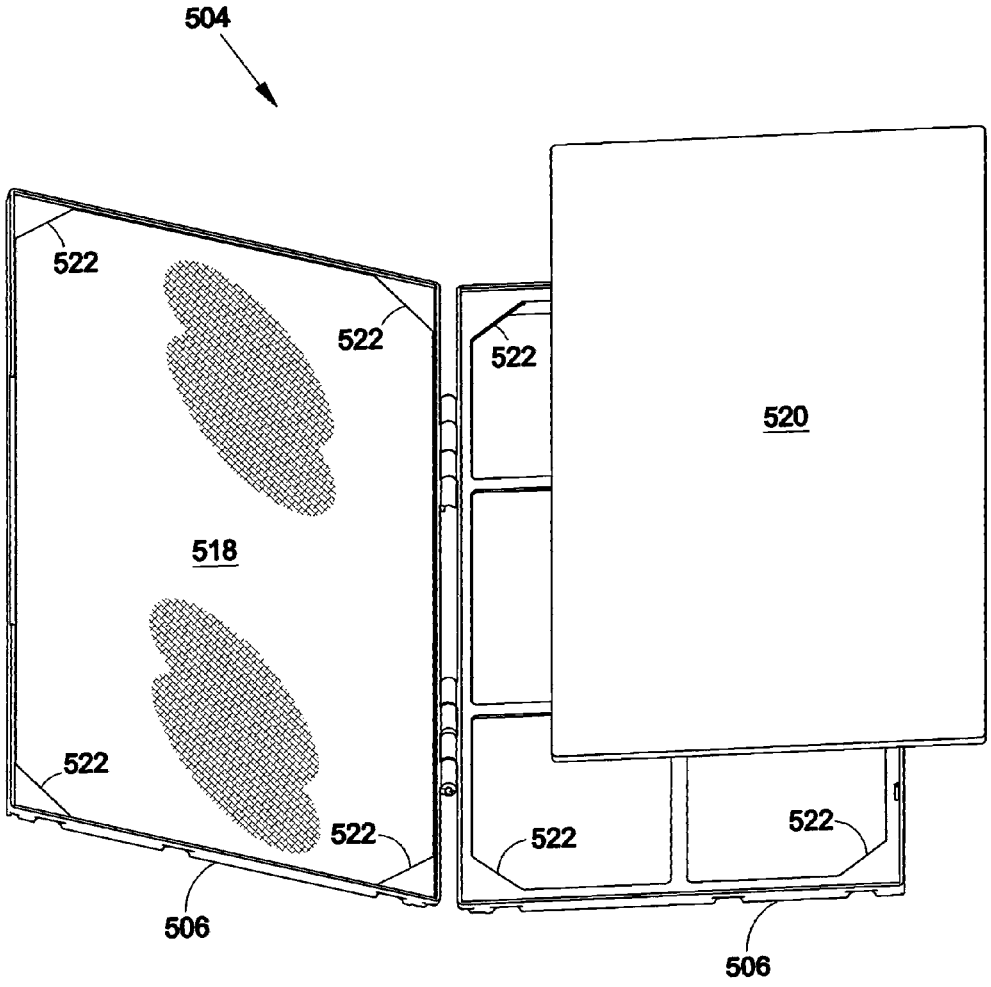
FIG. 10*d* is a perspective view of the filter shown in 10*b*, but rotated 90° and opened with the replaceability of the filter elements being illustrated.

Referring now to FIG. 10*c*, the hinged connection of the front and back halves of the filter frame 506 is illustrated. The two halves may be separated so that the mesh filter 518 and carbon filter 520 can be removed for cleaning or replacement. For example, the mesh filter 518 may be washed and reused many times while the carbon filter 520 should be cleaned fairly often to have the maximum elimination of odor or removal of smaller dust particles.

Figure 11B:
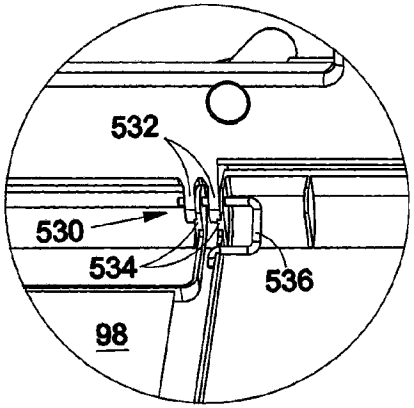
FIG. 11*b* is an enlarged perspective view of FIG. 11*a* along section lines 11*b* illustrating the double-hinged connection.
Figure 11A:
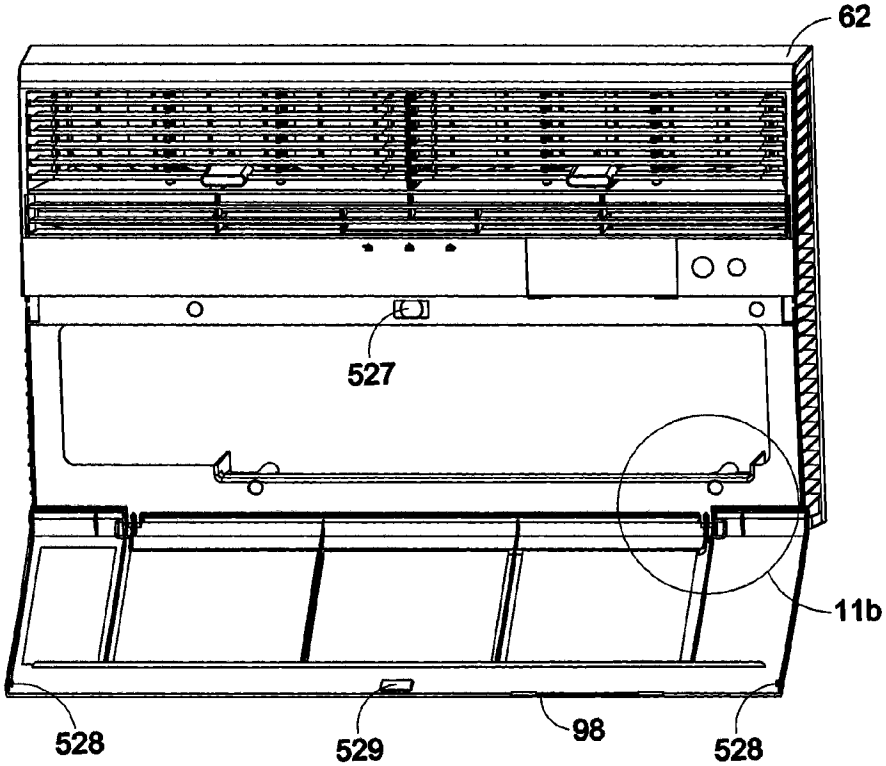
FIG. 11*a* is a front perspective view of the bezel with the lower hinged front door being opened.

Referring now to FIG. 11*a*, a front pictorial view is shown of the bezel 62 with the lower hinged door 98 being open. The lower hinged door 98 is held closed by tabs 528 extending over each edge of the bezel 62 in a snapping secure connection. To keep the center of lower hinged door 98 from sagging open in the middle, magnet 527 and metal striker plate 529 are secured in the positions shown in FIG. 11*a*. Therefore, when the lower hinged door 98 is closed, it will not sag in the middle.

The lower part of the lower hinged door 98 is secured to the bezel 62 by means of double hinged connector 530. (See FIG. 11*b*.) The double hinged connector 530 has two hinged tabs 532 formed as part of the bezel 62 and two hinged tabs 534 formed as part of the lower hinged door 98. By inner spacing the two hinged tabs 532 of the bezel 62 between the two hinged tabs 534 of the lower hinged door 98, and holding them in position by hinge clip 536, extra strength is provided to the hinged connector. Yet, at the same time the lower hinged door 98 can be removed by removing the hinge clips 536 from the double hinged connectors 530 on either side thereof. In the past, there has been a problem with the hinged connectors breaking, but with the double hinged connectors 530, that problem has been greatly reduced.

Figure 12A:
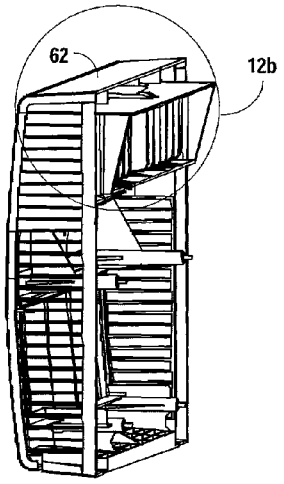
FIG. 12*a* is a rear perspective view of the bezel.
Figure 12B:
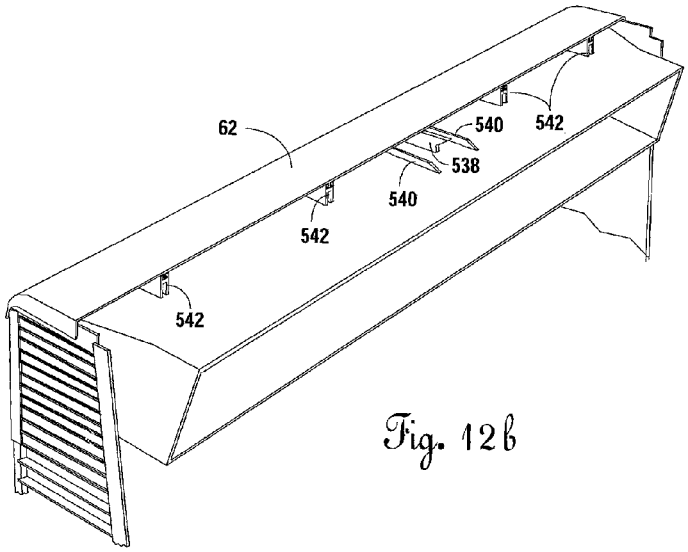
FIG. 12*b* is an enlarged perspective view of FIG. 12*a* along section lines 12*b*.

Referring to FIG. 12*a*, a rear perspective view of the bezel 62 is shown. In the enlarged feature from FIG. 12*a* that is shown in FIG. 12*b*, the alignment flange 538 is located in the center of the bezel 62. Side flanges 540 on either side of the alignment flange 538 also help to ensure that bezel 62 is aligned on unit 60 (not shown). Likewise, channels 542 also receive flanges therein to align the bezel 62 on the unit 60 (not shown). This provides for a very snug and secure fit of the bezel 62 in place on the unit 60.

Figure 13B:
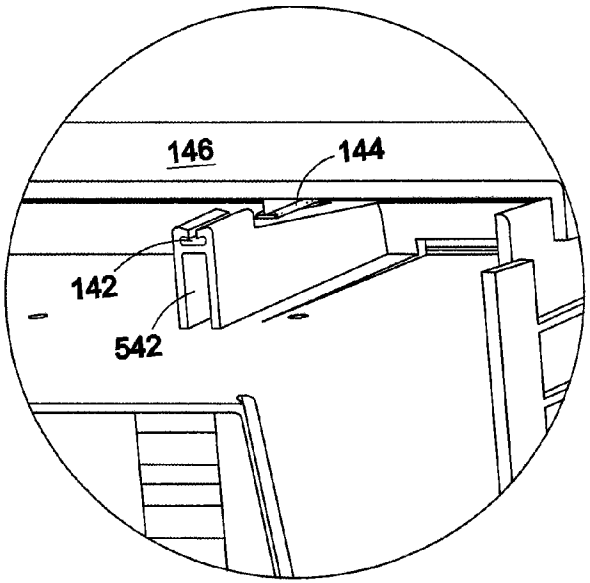
FIG. 13*b* is an enlarged perspective view of FIG. 13*a* along section lines 13*b*.
Figure 13A:
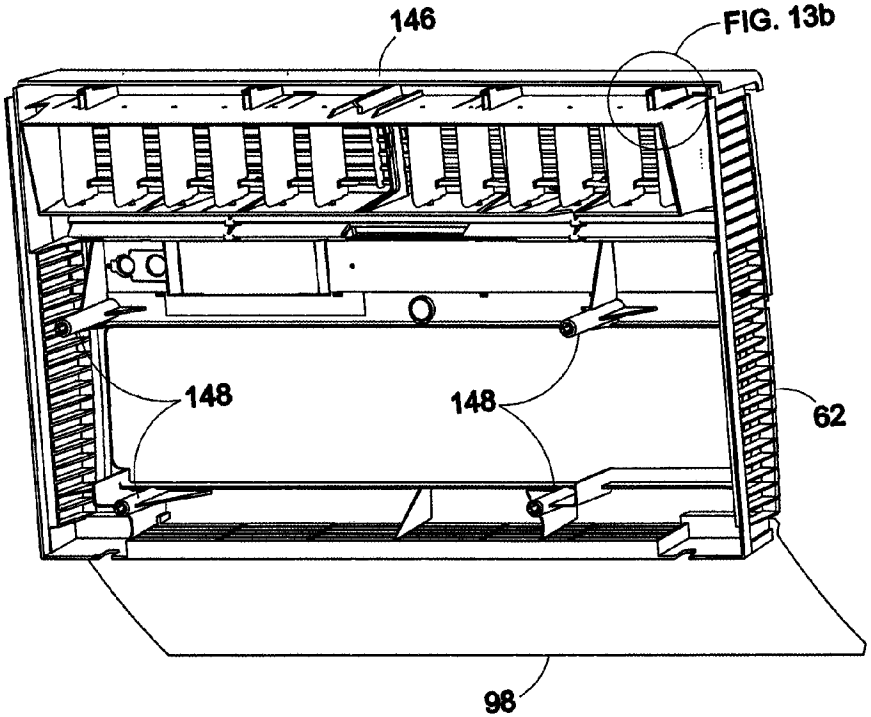
FIG. 13*a* is a rear perspective view of the bezel with the lower-hinged front door open.

Referring now to FIG. 13*a*, a rear perspective view of the bezel 62 is shown with the lower hinged door 98 being open. Alignment posts 148 extend rearward from the bezel 62 through which screws connect the bezel 62 onto the unit 60 (not shown). The alignment posts 148 extend through post openings 434 in the user interface mount 72 (see FIG. 5*a*). The top 146 of bezel 62 may be connected by a separate item such as a T-connector 144 that connects into upper channel 142 of a channel 542. In this manner, not only does channel 542 provide for alignment of the bezel, the upper channel 142 allows for connecting or disconnecting of the top 146.

What I claim is:

1. A room air conditioner and/or heat pump for conditioning the air of an enclosed space comprising:

an indoor coil;

an outdoor coil;

a compressor located between said indoor coil and said outdoor coil to compress a refrigerant flowing there between;

an accumulator on a suction side of said compressor for gathering said refrigerant prior to said compression;

an expansion device between said indoor and said outdoor coil, but on an opposing side from said compressor and said accumulator, said expansion device assisting in vaporization of said refrigerant flowing there through;

a fan for directing outside air through said outdoor coil;

a blower for forcing air through said indoor coil into said enclosed space;

sensors on said room air condition and/or heat pump for sensing conditions thereof;

a control system for receiving control system inputs from said sensors to generate control system outputs, which control system outputs control operation of said air conditioner and/or heat pump;

a user interface mount secured to a front of said air conditioner and/or heat pump, at least a portion of said control system being secured on said user interface mount, said user interface mount including:

a main body, handles on each end of said main body, each handle including a grasping portion located between said main body and said air conditioner and/or heat pump, cross-bracing ribs formed behind said main body, attachment for securing each handle to said room air conditioner and/or heat pump, said main body being generally horizontal when secured;

wire cable guides in said user interface to protect wiring cables, said wiring cables from said user interface extends through slots in said main body and through said wire cable guides to said main control so that said wiring cables are secure and protected;

a fresh air slide mounted in a fresh air slot on said user interface mount for retaining a fresh air control;

said user interface mount being used to insert said air conditioner and/or heat pump into an outer housing, or remove said air conditioner and/or heat pump from said outer housing.

2. The room air conditioner and/or heat pump for conditioning air of an enclosed space as recited in claim 1, wherein said control system is divided between a main control and a user interface, said user interface being secured on said user interface mount.

3. The room air conditioner and/or heat pump for conditioning air of an enclosed space as recited in claim 2, wherein said user interface mount has guides and/or slots for directing and protecting wiring cables including a user interface wiring cable between said main control and said user interface.

4. The room air conditioner and/or heat pump for conditioning air of an enclosed space as recited in claim 3, wherein said user interface mount includes clamps for holding said wiring cables in position.

5. The room air conditioner and/or heat pump for conditioning air of an enclosed space as recited in claim 1 includes a reversing valve between said indoor coil and said outdoor coil to change from heating to cooling, and vice versa, of said enclosed space in response to said control system outputs.

6. The room air conditioner and/or heat pump for conditioning air of an enclosed space as recited in claim 2, wherein said main control is in a main control housing located in a main control housing mount.

7. The room air conditioner and/or heat pump for conditioning air of an enclosed space as recited in claim 6, wherein said main control housing allows access to a main control circuit board through a front thereof.

8. The room air conditioner and/or heat pump for conditioning air of an enclosed space as recited in claim 7, wherein said main control housing has a moisture control flange to prevent accumulated moisture from dripping on said main control circuit board.

9. The room air conditioner and/or heat pump for conditioning air of an enclosed space as recited in claim 7, wherein said main control housing has battery access through a front thereof for replacing a battery on said main control circuit board.

10. The room air conditioner and/or heat pump for conditioning air of an enclosed space as recited in claim 1 further comprising a square connector for directing a power cord for said air conditioner and/or heat pump out of an outer housing on either a left or right side thereof while simultaneously providing strain relief.

11. The room air conditioner and/or heat pump for conditioning air of an enclosed space as recited in claim 1, wherein said air conditioner and/or heat pump has an outer housing with a main unit located therein and a bezel on a front thereof.

12. The room air conditioner and/or heat pump for conditioning air of an enclosed space as recited in claim 11 including a hinged door that can be opened from a front of said bezel, double hinges on either side of said hinged door and tabs for retaining said hinged door in a closed position.

13. The room air conditioner and/or heat pump for conditioning air of an enclosed space as recited in claim 12 including a filter accessible through said hinged door, said filter held in position by a filter slide on said user interface mount.

14. The room air conditioner and/or heat pump for conditioning air of an enclosed space as recited in claim 13, wherein said filter has a filter frame with a mesh filter removably attached on a first side thereof and a carbon filter removably attached on a second side thereof, air being delivered to said enclosed space flowing through both said mesh filter and said carbon filter.

15. The room air conditioner and/or heat pump for conditioning air of an enclosed space as recited in claim 11 includes channels and/or flanges for directing and securing said bezel into position on said main unit.

16. A user interface mount for a room air conditioner and/or heat pump having an outer housing, main unit in said outer housing, a bezel on a front of said outer housing, a filter, a main control, a user interface and wiring cables including between said main control and said user interface, said user interface mount comprising:

a main body;

handles on each end of said main body; each handle including a grasping portion located between said main body and said main unit;

cross bracing ribs formed behind said main body;

attachment for securing each handle to said main unit, said main body being generally horizontal when secured;

a mount for said user interface on a front of said main body so that said user interface is accessible through said bezel;

wiring cable guides in said user interface mount to protect said wiring cables, said wiring cables from said user interface extends through slots in said main body and through said wiring cable guides to said main control so that said wiring cables are secure and protected;

a fresh air slot in said main body for receiving a fresh air control therein, said fresh air slot allowing for sliding motion of said fresh air control to open or close a fresh air vent;

said user interface mount being used to insert said main unit in said outer housing, or remove said main unit from said outer housing.

17. The user interface mount for a room air conditioner and/or heat pump as recited in claim 16 includes tits for guiding said user interface into position on said front of said main body.

18. The user interface mount for a room air conditioner and/or heat pump as recited in claim 16 includes a slide on a back of said main body for directing said filter into position when said filter is installed.

19. The user interface mount for a room air conditioner and/or heat pump as recited in claim 16 includes a second wiring cable guide to secure and protect said wiring cables extending around at least one of said handles.

20. The user interface mount for a room air conditioner and/or heat pump as recited in claim 16 includes post openings in each of said handles, said post openings receiving and guiding posts from said bezel into position.

* * * * *